US005997124A

United States Patent [19]

Capps et al.

[11] Patent Number: 5,997,124

[45] Date of Patent: Dec. 7, 1999

[54] METHOD AND APPARATUS FOR DROP VOLUME NORMALIZATION IN AN INK JET PRINTING OPERATION

[75] Inventors: Larry Capps; David Albertalli; Donald R. Billet, all of San Jose; Gus A. Adriancen, Santa Clara, all of Calif.

[73] Assignee: Raster Graphics Inc., San Jose, Calif.

[21] Appl. No.: 08/815,137

[22] Filed: Mar. 12, 1997

[51] Int. Cl.[6] ..... B41J 29/393; B41J 29/38

[52] U.S. Cl. ..... 347/14; 347/19

[58] Field of Search ..... 347/14, 9, 10, 347/12, 19

[56] References Cited

U.S. PATENT DOCUMENTS

| | | | |
|---|---|---|---|
| 4,709,244 | 11/1987 | Platt et al. . | |
| 4,922,270 | 5/1990 | Cobbs et al. . | |
| 5,049,898 | 9/1991 | Arthur et al. | 347/19 |
| 5,250,956 | 10/1993 | Haselby et al. | 347/19 |
| 5,473,351 | 12/1995 | Helterline et al. | 347/19 |
| 5,699,091 | 12/1997 | Bullock et al. | 347/19 |
| 5,847,722 | 12/1998 | Hackleman | 347/19 |

*Primary Examiner*—Richard Moses
*Attorney, Agent, or Firm*—Burns, Doane, Swecker & Mathis, L.L.P.

[57] ABSTRACT

The present invention is generally directed to providing drop volume normalization of the ink jet nozzles in an ink jet printing operation to alleviate and/or eliminate banding effects due to imprecise placement of ink drops on the printed sheet and variations in the volume of drops produced by different ink jet nozzles of the print device. Exemplary embodiments relate to a method and apparatus for controlling a print device having at least one ink jet nozzle by adjusting an offset control of a power supply used to control drop volume of the at least one ink jet nozzle. In a print device configured with piezoelectric ink jet nozzles, the output drop volume of the nozzle can be controlled within a predetermined range by adjusting the voltage supplied to the ink jet nozzle. As those skilled in the art will appreciate, this offset control of drop volume will result in a change to output ink velocity as well. Accordingly, exemplary embodiments of the present invention further compensate a firing time of the at least one ink jet nozzle as a function of the offset control to account for a change in output ink velocity of the at least one ink jet nozzle.

18 Claims, 4 Drawing Sheets

METHOD AND APPARATUS FOR DROP VOLUME NORMALIZATION IN AN INK JET PRINTING OPERATION

BACKGROUND OF THE INVENTION

1. Field of the Invention

The present invention relates generally to control of a printing device, and more particularly, to provide drop volume normalization in an ink jet printing operation.

2. State of the Art

Printing devices, such as ink jet printing devices, are well known and available from such manufacturers as, for example, Hewlett Packard and NCAD. A typical ink jet printing device includes plural print heads, each of which includes a plurality of ink jet nozzles for printing in a given color of ink. Different print heads can be provided for different colors. The plural ink jet nozzles associated with a given color of printing ink can be displaced from one another in a vertical direction. As the printing device is repeatedly scanned back and forth across a printable medium, such as a paper sheet, the ink jet nozzles of the various print heads are activated to lay drops of ink on the sheet at precise locations. In typical color printing, between four and six different colors of ink are laid down over an area by successive heads, in successive scans across the sheet.

The ink jet nozzles of the print head or heads use very fine ink sprays to produce drops that collectively represent an image on a sheet being printed. Multiple print head arrangements, for producing multicolor images using such colors as cyan, magenta, yellow and black, are precision mounted relative to one another in the print device so that ink drops can be laid down on the sheet in precise locations. As mentioned previously, the print device is typically located on a movable carriage that scans back and forth above the sheet. Relative vertical movement between the print device and the sheet is provided between each scan, so that a different portion of the sheet can be printed during each scan. As those skilled in the art will appreciate, the nozzles on each of the multiple print heads must be controlled to lay down ink drops in precise locations relative to drops laid down by the other print heads.

Ink jet printing devices are often used to produce high quality, high resolution images on wide webs of paper at fast printing rates. To maintain quality as high as possible, accurate control of paper feed and scanning speed are necessary. Further, to produce high resolution images which do not include visible horizontal differences, typically referred to in the industry as "banding" effects, it is important that all ink drops laid on the sheet by the print device be accurate placed in a predetermined location on the sheet. To address banding, it is further important to control the drop volume output by each ink jet nozzle so that all printed drops on the sheet are consistent in size.

Accordingly, it would be desirable to enhance the control of the ink jet nozzles in an ink jet print device to further alleviate banding effects, and thus enhance the quality and resolution of a reproduced image.

SUMMARY OF THE INVENTION

The present invention is generally directed to providing drop volume normalization of the ink jet nozzles in an ink jet printing operation to alleviate and/or eliminate banding effects due to imprecise placement of ink drops on the printed sheet and variations in the volume of drops produced by different ink jet nozzles of the print device. Exemplary embodiments relate to a method and apparatus for controlling a print device having at least one ink jet nozzle by adjusting an offset control of a power supply used to control drop volume of at least one ink jet nozzle. In a print device configured with piezoelectric ink jet nozzles, the output drop volume of the nozzle can be controlled within a predetermined range by adjusting the voltage supplied to the ink jet nozzle. As those skilled in the art will appreciate, this offset control of drop volume will result in a change to output ink velocity as well. Accordingly, exemplary embodiments of the present invention further compensate a firing time of at least one ink jet nozzle as a function of the offset control to account for a change in output ink velocity of at least one ink jet nozzle.

BRIEF DESCRIPTION OF THE DRAWINGS

Other objects and advantages of the present invention will become apparent from the following detailed description of preferred embodiments when read in conjunction with the accompanying drawings, wherein like elements are designated by like reference numerals, and wherein.

DETAILED DESCRIPTION OF THE PREFERRED EMBODIMENTS

Figure 1:
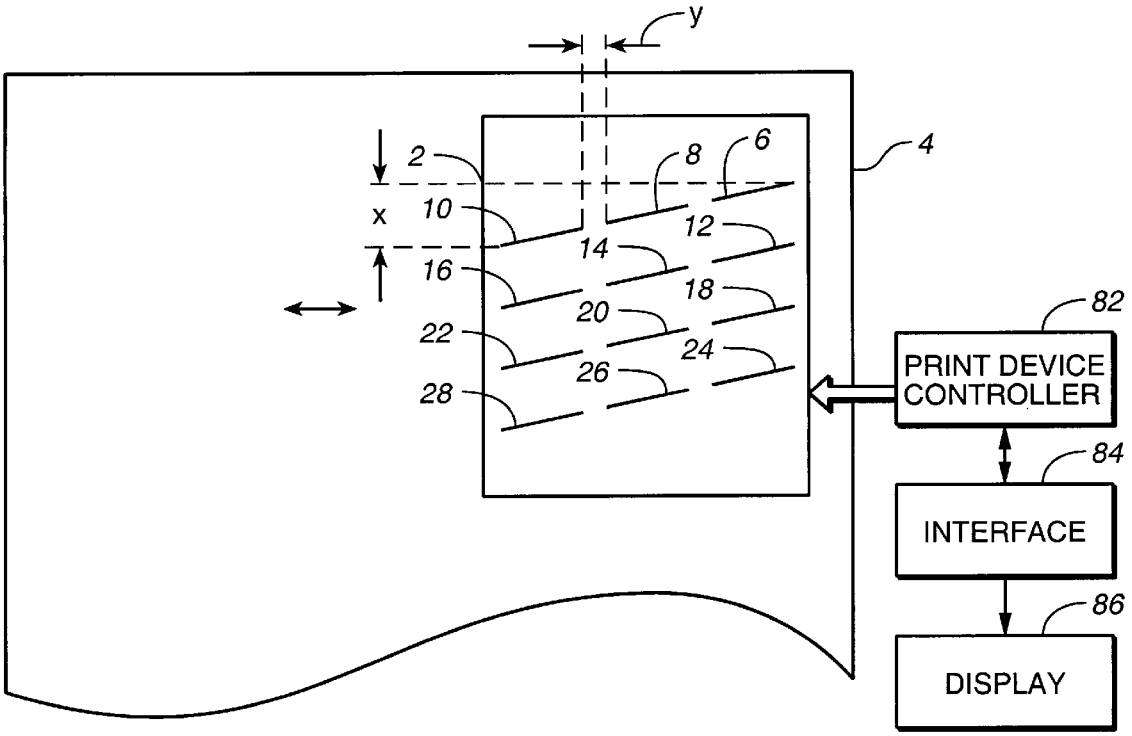
FIG. 1 illustrates an exemplary print device and control system therefor.

FIG. 1 illustrates a print head and print head control system which can be used in accordance with exemplary embodiments of the present invention. In the exemplary FIG. 1 illustration, a print device 2 having at least one print head is positioned over a sheet 4 of printable material (e.g., paper). Components used to mount the print device, and print heads in the print device, do not constitute part of the present invention and are therefore not illustrated in FIG. 1 for purposes of simplifying the drawing. However, for a greater discussion of a configuration of ink jet nozzles associated with a print device which can be controlled in accordance with exemplary embodiments of the present invention, reference is hereby made to copending U.S. application Ser. No. 08/815,590, U.S. Pat. No. 5,782,184 Attorney Docket No. 031228-003 entitled "PRINTER HEAD CARRIAGE AND METHOD FOR ALIGNING PRINTER HEADS ON A PRINTER HEAD CARRIAGE", filed on even date herewith, the disclosure of which is hereby incorporated by reference in its entirety.

Referring again to FIG. 1, the print device 2 can be seen to include plural print heads labeled 6–28. While any number of print heads can be included on the print device 2, for purposes of simplifying the following discussion, only 12 such print heads are illustrated. In an exemplary embodiment, the three print heads 6, 8 and 10 are associated with a first color (e.g., black). The second row of three print heads 12, 14 and 16 are associated with a second color (e.g., yellow). A third row of print heads 18, 20 and 22 are associated with a third color (e.g., cyan). A fourth row of print heads 24, 26 and 28 are associated with a fourth color (e.g., magenta). Although three print heads are shown with respect to each color, those skilled in the art will appreciate that any number of such print heads can be associated with each color. Further, those skilled in the art will appreciate that any number of rows of print heads can be used to accommodate any number of different colors (e.g., six color printing can be implemented by adding additional rows of print heads).

The print device 2 is configured to scan back and forth horizontally across a printable medium, such as the sheet 4, and can be configured to print in both directions. To better understand the following discussion, an exemplary operation of the print heads will be provided.

Each of the print heads 6-28 includes a number of ink jet nozzles. For example, each of the print heads can be configured to include 128 such nozzles arranged along the length of the print head. When viewing the print heads associated with a given color (e.g., the print heads 6, 8 and 10 associated with the color black) in a vertical direction of FIG. 1, the print heads are oriented at an angle such that the lower most nozzle of the print head 6 is above the uppermost nozzle of the print head 8. Similarly, the lowermost nozzle of the print head 8 is located above the uppermost nozzle of the print head 10. Each row of print heads (i.e., the lower rows associated with the remaining colors, magenta, cyan and yellow) are similarly configured.

In a non-overlap mode of operation, a printed band would be produced on the sheet 4 by traversing the print device 2 across the sheet, with ink jet nozzles being selectively activated. For example, to produce a solid black band, all 128 ink jet nozzles in each of the print heads 6, 8 and 10 would be activated. Because the ink jet nozzles do not overlap in a vertical direction, a solid band would be produced as the print device 2 scans across the sheet, and this band would have a vertical height labeled "x". Note that the height "x" of the band is defined by the vertical span between the location of the uppermost nozzle of the print head 6 and the lowermost nozzle of the print head 10. A solid band of the colors magenta, cyan and yellow could be produced during the same scan in similar fashion to print four different color bands in one scan.

Those skilled in the art will appreciate that as the print device 2 scans back and forth across the paper, the print device 2 can be controlled to print in both directions. With each scan, the print device 2 moves downward in the vertical direction and/or the sheet 4 is moved upward, with the total relative movement between the print device and the sheet corresponding to one band. The various ink jet nozzles in the print heads 6–28 can be selectively controlled to lay down drops of ink of a given color at precise locations on the sheet, and thereby print a desired image of high resolution. The composite of these dots on the page results in the production of any desired image on the sheet 4.

In an exemplary embodiment, the print heads associated with a given color (e.g., the print heads 6, 8 and 10 associated with the color black) can be separated from one another in the horizontal direction by a predetermined width labelled "y" in FIG. 1. The separation instance "y" can be also provided between each of the print heads in the remaining rows of print heads for the colors magenta, cyan and black.

As those skilled in the art will appreciate, the ink jet nozzles themselves do not constitute a part of the present invention, and are readily available from such manufacturers as Hewlett Packard. As those skilled in the art will further appreciate, the nozzles can be piezoelectric controlled nozzles which can vary in their specifications with respect to their ink spray, or "firing", rate. This rate dictates the speed with which the scanning can be implemented. That is, the rate with which an ink jet nozzle can create a drop of a given size (or volume) on a sheet will dictate the speed with which the scan head can be moved across the sheet.

In addition to accurately controlling the mechanical configuration of the print device to ensure that ink jet nozzles will be capable of laying down ink drops at precise locations on the sheet, it has been recognized that banding effects can be alleviated if the drop volume of ink drops produced from each of the plurality of nozzles in the print device is consistent among all such nozzles. Where print heads having piezoelectric nozzles, such as those readily available from off-the-shelf manufacturers like Hewlett Packard are used, the voltage supplied to the print head can be adjusted within a predetermined range to vary the drop volume from the given head's ink jet nozzles. Accordingly, exemplary embodiments include a power supply 88 which includes a plurality of voltage regulators.

In an exemplary embodiment, a voltage regulator can be provided for each print head of the print device 2. Regulators included in the print device control 82 for each of the print heads can then be used to adjust the voltage supplied to each print head and thereby control the drop volume produced by the ink jet nozzles from each print head. The manner by which such voltage control is achieved is described in greater detail below.

In accordance with exemplary embodiments of the present invention, adjustment of the voltage regulators provides a voltage offset control of the power supply, and thus controls the drop volume of the ink jet nozzles on a print head-by-print head basis. Of course, those skilled in the art will appreciate that if even greater control is desired, a voltage regulator can be provided for each ink jet nozzle in each print head. However, for purposes of understanding exemplary embodiments of the present invention, such control is unnecessary.

Once the drop volume produced by the ink jet nozzles in each of the print heads has been rendered consistent, a significant alleviation of banding effects has been addressed. However, to further address banding effects, exemplary embodiments of the present invention compensate a firing time of the ink jet nozzles in each print head as a function of the voltage offset control. As those skilled in the art will appreciate, adjustments to the drop volume of the ink jet nozzles in a print head will vary the size of the ink drop output from the nozzles of that print head. As such, the velocity with which the drop is sprayed from the nozzle will be altered. Alterations in this velocity, will, of course, depend on the viscosity of the particular ink, which will vary from color to color. In accordance with exemplary embodiments, a look-up table can be used to correlate changes in the voltage offset used for adjusting ink drop volume to resultant changes in ink velocity associated with spraying the ink from an ink jet nozzle for each ink. These known changes in velocity can be used to compensate the firing time of an ink jet nozzle whose power supply has been adjusted, and thereby account for a change in the output ink velocity of the ink jet nozzle.

Figure 2:
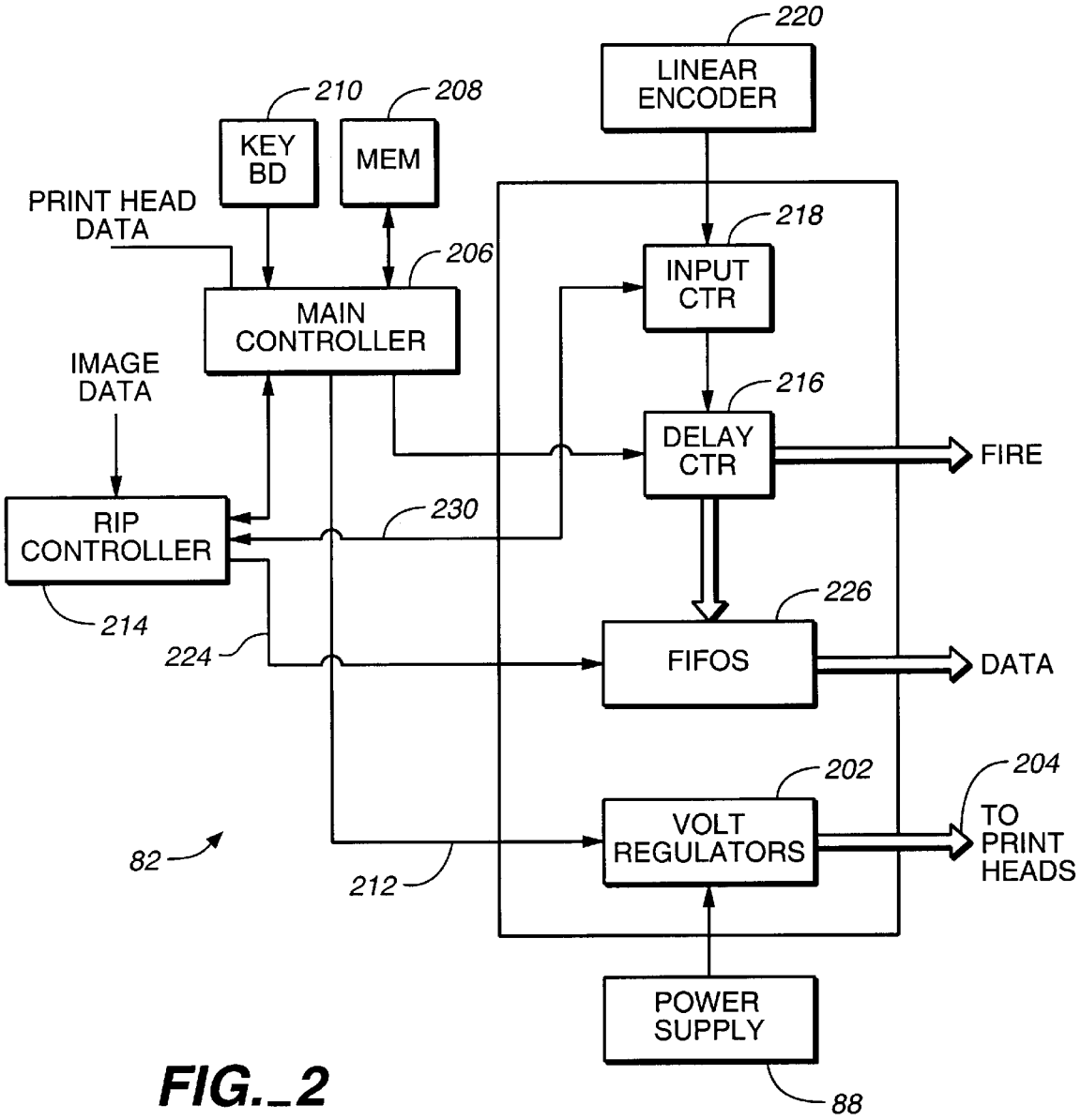
FIG. 2 illustrates a portion of the FIG. 1 print device control as configured in accordance with an exemplary embodiment of the present invention.

The manner by which offset control of the power supply to each print head is used to control drop volume, and the manner by which a firing time of ink jet nozzles in a print head whose power supply has been adjusted will be described in greater detail with respect to FIG. 2. Referring to FIG. 2, a portion of the print device control 82 configured in accordance with exemplary embodiments of the present invention is illustrated.

As shown in FIG. 2, the print device control 82 includes means for adjusting an offset control of a power supply used to control drop volume of the ink jet nozzles in the print device on a print head-by-print head basis. In the FIG. 2 embodiment, this adjustment is provided by voltage regulators 202 which receive an output from the power supply (e.g., a nominal 45 volt power supply) 88 of FIG. 1. The exemplary print device 2 of FIG. 1 includes 12 heads. The voltage regulator 202 includes one regulator per print head (e.g., for the FIG. 1 print device, 12 regulators) such that the nominal 45 volt power supply can be independently adjusted for each print head on a head-by-head basis. An output 204 from each of the 12 regulators is supplied to each of the 12 print heads 6–28 of FIG. 1. Each of the voltage regulators included in the voltage regulator 202 is controlled in response to an output from a main controller (e.g., microprocessor) 206.

As those skilled in the art will appreciate, print heads readily available off-the-shelf typically include manufacturer specified information. This manufacturer specified information can be provided with the print head in any conventional form. The manufacturer specified information typically provided for each print head includes a range of defined characteristics associated with the ink jet nozzles included on the head. The manufacturer specified information which is typically provided with a print head includes: (1) a characteristic average velocity of the ink jet nozzles included in the print head (i.e., an average speed of nozzle firing); (2) a characteristic drop volume of the ink jet nozzles included in the print head; (3) a serial number of the print head. A typical characteristic average velocity of the ink jet nozzles in a given print head will range from 6 meters per second to 8 meters per second. A typical characteristic drop volume in the ink jet nozzles in a print head will range from 28 to 35 picoliters.

In accordance with exemplary embodiments, when a print head is received from the manufacturer, the information regarding manufacturer specifications for the print head is supplied into a data base, such as memory (e.g., hard disk) 208, via the main controller 206. This information can then be reproduced on a bar code label that is affixed to the print head. During use of the print head, characteristic information associated with the print head can be read from the bar code.

Via a user interface 210 of the main controller 206, the user can set a specified characteristic drop volume for the print heads to be included in the print device. Alternately, after the characteristic drop volume of all print heads to be used in the print device has been stored in the hard disk, an average of the range specified by the manufacturer for each print head to be used can be averaged to establish a set value.

After a set value has been established for the range of drop volume characteristics to which all print heads are to conform, a look-up table included in the memory 208 can be accessed to determine offset voltages for each of the print heads to render the characteristic drop volume for all print heads consistent. For example, if all but one of the print heads is identified by the manufacturer to include a characteristic drop volume in the range of 28 to 35 picoliters with one exception, then the main controller will access the look-up table to determine how must voltage offset is necessary for the one print head which does not conform to this range. The main controller will then send a voltage offset control signal via signal path 212 to the voltage regulator 202 so that the voltage control to that print head can be adjusted accordingly. As a result, a voltage offset is provided via signal paths 204 to any print head whose characteristic drop volume does not conform to the set value. The drop volume characteristic of all drop print heads included in the print device is therefore rendered consistent.

Having adjusted an offset control of the power supply used to control drop volume in each of the print heads, those skilled in the art will appreciate that output ink velocity of any print heads which have been adjusted will be affected. Further, it may be that the print heads received from the manufacturer include characteristic average velocities which differ from one print head to the next. Accordingly, exemplary embodiments of the present invention further address banding effects by compensating firing times of the ink jet nozzles on a head-by-head basis as a function of these variations to account for differences in output ink velocity from each of the other heads.

As mentioned previously, characteristic drop velocity for each print head is typically supplied by the print head manufacturer. As with the characteristic drop volume data, this information can be loaded via the main controller 206 into the memory 208. A set value for the characteristic average velocity can be set either by the user, or by an averaging computation similar to that described above with respect to the establishment of a set value for characteristic drop volume. Variations of individual ink jet nozzles from the set value can then be used to determine an appropriate compensation value for each ink jet nozzle. In addition, a test as will be described with respect to FIG. 4 can be run to identify any heads whose firing time should be compensated for any reason (for example, to detect the need for firing time compensation even when all heads conform to the characteristic average velocity). Where an offset control has been supplied to a given print head, the amount of the voltage offset can be supplied to a look-up table in the memory 208 to produce a corresponding compensation for the firing time of ink jet nozzles in that print head due to an adjustment of the power supply (i.e., and thus the drop volume).

To identify an appropriate amount of firing time compensation in response to adjustments of print head voltage, an empirical test can be implemented wherein adjustments to the voltage offset control of the power supply are made for each of the different inks to be used in the printing process. Resultant variations in the placement of ink drops on a printed sheet as a result of these voltage offsets can then be examined, and compensations to the firing time can be introduced to determine an appropriate firing time compensation necessary to compensate a voltage offset for each ink of given viscosity. Additional amounts of compensation can, if desired, be introduced by the user.

Figure 4:
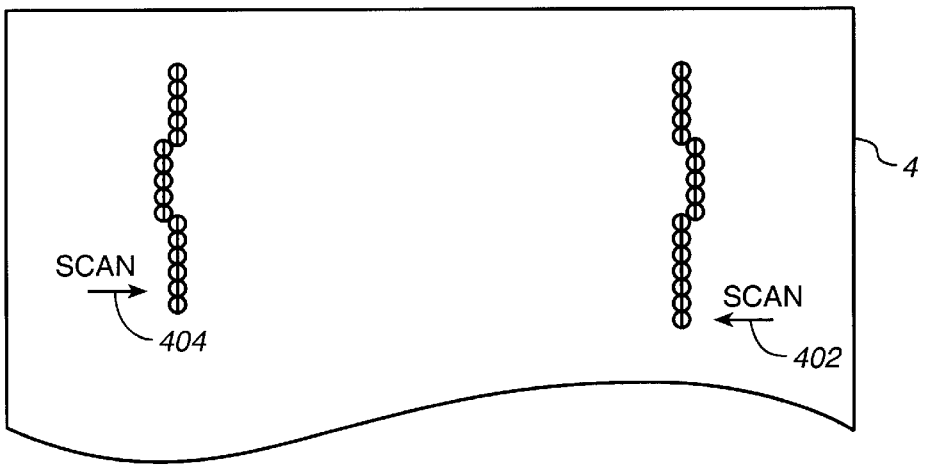
FIG. 4 shows an effect of not compensating the firing time of nozzles in a given print head where the voltage used to control drop volume output from nozzles of the print head has been adjusted.

For example, FIG. 4 illustrates an effect of adjusting offset control to the middle print head 8 used to print black ink (i.e., note that the print head 8 is located between print heads 6 and 10 which are also used to print black ink). During a right-to-left scan 402 of the print head device 2 over sheet 4 to produce a vertical line, a variation in the voltage offset control of the print head 8 can be seen to create a variation in the vertical line. The fact that this variation is due to a firing time error of the ink jet nozzles in the print head 8 can be verified by initiating a rescan 404 of the print device 2 from left-to-right over the sheet. If the deviations from the vertical line are due to timing differences, an equal and opposite effect should occur in the printing of the vertical line during this rescan 404.

To compensate for firing time errors due to voltage offsets, exemplary embodiments introduce an appropriate delay or advance for each affected nozzle. In the foregoing example, a typical print head can be considered to have a plus or minus 4 volt range of drop volume control. That is, for variations of plus or minus 4 volts to the print head, the drop volume can be adjusted. For variations greater than this range, little or no resultant affect to drop volume will occur. Thus, exemplary embodiments exploit this effect to adjust drop volume by changing the voltage supplied to the print head on a print head-by-print head basis. Afterwards, firing times of the ink jet nozzles in the print heads can be adjusted to compensate for offsets due, among other reasons, to the drop volume adjustment.

To better understand how an exemplary firing time compensation is affected, a brief review of a manner by which image data is received into the print device control 82 will be discussed. Referring to FIG. 2, image data from an image that has been scanned for reproduction is supplied to a raster image process controller 214 (e.g., microprocessor). For example, an original image can be scanned horizontally and data supplied to the raster image process controller in sequential fashion, with each pixel of the image being provided in any conventional color format (e.g., CYMB format where CYMB represents cyan, yellow, magenta and black). The image data is processed by the raster image process controller to transform the image file one scan at a time (i.e., one pixel by the full width of the image). Because 384 ink jet nozzles are included in the exemplary FIG. 1 print device for each color, 384 scans of the original image are performed before a complete image file is assembled for processing in accordance with exemplary embodiments of the present invention. Those skilled in the art will appreciate that the manner of scanning an original image as described above is an industry standard, and that further discussion of such scanning for acquisition of data is unnecessary.

The image data is received in an interleaved form, and the raster image process controller splits data apart to build bands for each color consisting of 384 dots or pixels. For example, in scanning across the original image during a first scan, 384 bits of data associated with black are stored in, for example, a rectangular data format to control 384 ink jet nozzles of the print device 2 during its first passage over the sheet 4 during reproduction of the image.

Once data acquired from the original image has been ordered by the raster image process controller 214, the data is shifted to account for horizontal displacement of the three heads 6, 8 and 10. Further, the raster image process controller shifts this data to account for the angled orientation of the heads 6, 8 and 10 in conventional fashion, as well as for advance timing information from main controller 206 in a manner to be described later. This operation, is of course, repeated for each of the remaining colors to be produced by the remaining heads of the print device 2. Because the manner by which an image file is created to account for horizontal displacement of the various print heads and angled orientation of the various print heads is well known to those skilled in the art, a further discussion of the creation of a data file is unnecessary. However, suffice it to say that once such a data file is determined, the data stored will be compensated to account for firing time compensation of each nozzle in accordance with exemplary embodiments of the present invention.

For example, data which has been stored in the memory 208 includes information for compensating the firing time of ink jet nozzles in any print head whose power supply has been adjusted by the aforementioned offset control. For any ink jet heads so affected, the main controller 206 determines whether the compensation required for the nozzles of a particular print head should advance the firing time of the ink jet nozzles or delay the firing time of the ink jet nozzles. If the firing time is to be delayed, a relatively straightforward compensation can be provided by supplying an appropriate delay output from the look-up table to a delay register (e.g., counter) 216.

The delay register, or delay counter, 216 can include a separate register (e.g., counter) for each print head. In an exemplary embodiment, each such register is configured to produce a delay which is equal to or less than one pixel. For example, each delay register can be configured to store a fractional pixel delay of 1/6 pixel, 2/6 pixel, 3/6 pixel, 4/6 pixel, 5/6 pixel or 6/6 pixel. An input counter 218 is restarted by signals from the linear encoder 220 that occur at a resolution of one full pixel. The counter then enables the data to the FIFOs via signal 230. The counter 218 counts the input data and stops the data after 128 bits per head has been sent to each FIFO. Counter 218 continues to count up to approximately 200 at which time it will be restarted by the linear encoder. As counter 218 counts up, it activates delay triggers at approximately 1/6 pixel increments (every 32 counts).

In an exemplary embodiment, one FIFO per print head is provided, each FIFO including entries for each of the 128 nozzles in a print head. In an exemplary embodiment, each FIFO includes one column of data for each head, wherein each column includes one bit of data representing one dot to be printed by each of the 128 nozzles in a given print head. Thus, in an exemplary embodiment, each FIFO is 128 rows by 1 column, so that 1 bit of data is stored for each nozzle. In operation, the FIFOs collectively receive, in parallel, a bit of data for each nozzle from the raster image process controller. Columns of data are shifted serially into the FIFOs using counter 218 and out of the FIFOs 226 using the output of delay registers 216. Each delay register is set up by the main controller 206 to begin operation (i.e., become enabled) when activated by one of the delay triggers from counter 218. Once a delay counter is activated, it enables a respective FIFO 226 to output data to the head until all 128 bits have been sent. At that point the fire signal is sent to the head to eject the ink drops.

Figure 5:
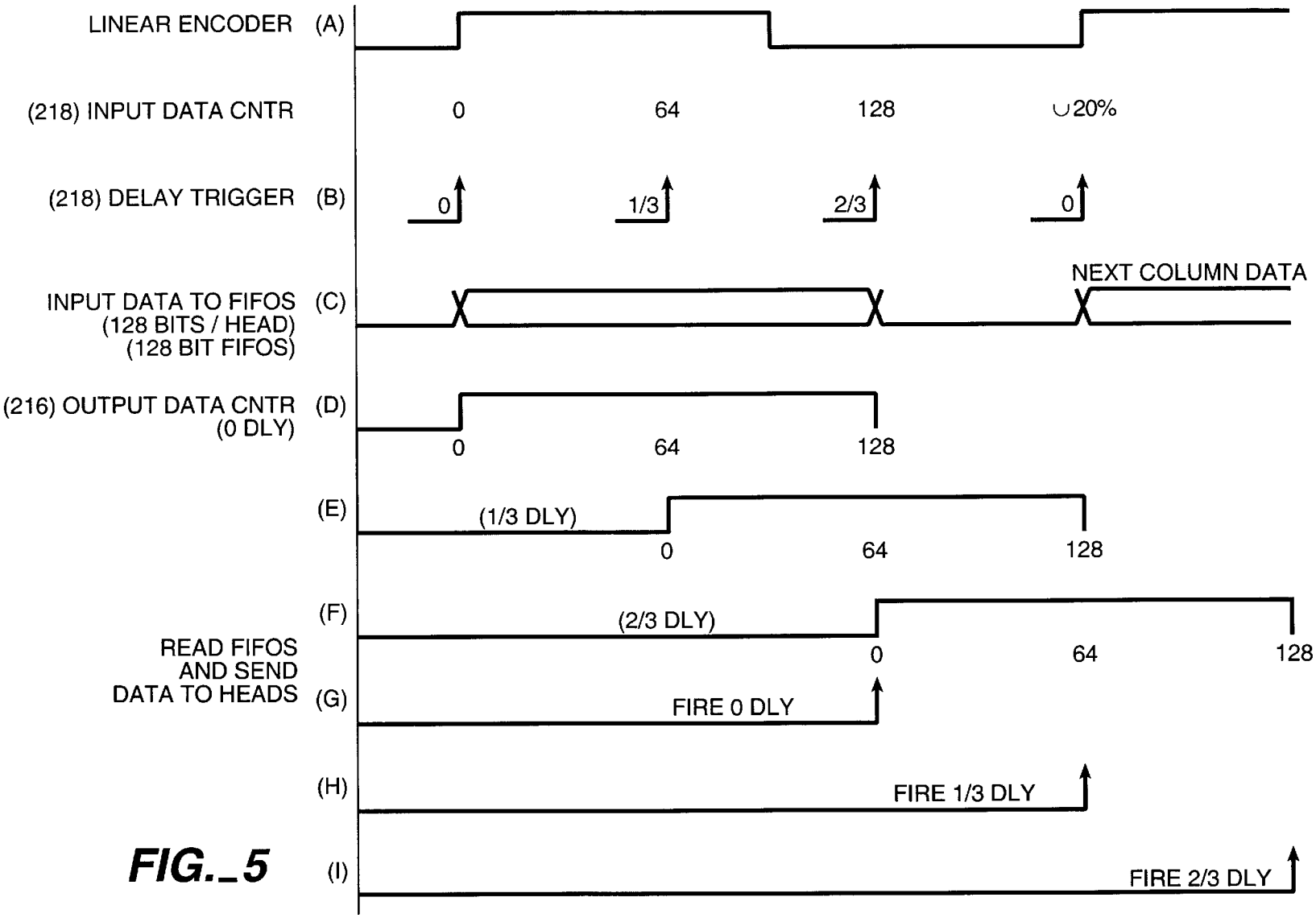
FIGS. 5A–5I shows an exemplary timing diagram associated with the control of FIG. 2.

Referring to FIG. 5 a timing diagram associated with an exemplary control of print heads in accordance with the FIG. 2 print device control is illustrated. Referring to FIG. 5A, an output from the linear encoder 220 is illustrated. This output is provided as an input to the input counter 218. FIG. 5B illustrates delay triggers associated with delays of 1/3 pixel, 2/3 pixel and a full pixel. FIG. 5C illustrates input data supplied to the FIFOs for a particular 128 nozzle print head. FIG. 5D illustrates an exemplary output of the delay counter 216, which transitions at the resolution of one pixel (e.g., which counts from 0 to 128). FIGS. 5E and 5F illustrate delays of 1/3 pixel and 2/3 pixels, respectively for controlling the output of a given print head with a 1/3 pixel delay or a 2/3 pixel delay. FIGS. 5G–5I illustrate exemplary fire signals supplied to the print heads to control the firing based on the completion of sending data to the heads as illustrated in FIGS. 5D–5F, respectively.

In contrast to the foregoing discussion of delaying the printing of dots, appropriate compensation for a given drop volume requires an advancing of the firing time, a delay cannot be simply added to the otherwise uncompensated firing time of the head. Rather, in this case, the ink jet nozzle must be controlled to fire at an earlier point in time. Accordingly, where an advance in the firing time of an ink jet nozzle is necessary, as determined by the output from the look-up table in response to drop volume adjustment of the particular head, the main controller 206 sends a control signal to the raster image process controller 214 to this effect. The raster image process controller then advances the data one full pixel for the affected head and sends it via a signal path 224 to a respective memory (e.g., first-in first-out memory) 226. This advanced data causes the firing time of an affected nozzle to be advanced by one full pixel. The main controller 206 further supplies a delay to the delay register 216 for this head. The collective result of advancing the ink jet firing time of a given head by one full pixel via the raster image process controller 214, and then adding in a fractional delay to this resultant firing time via delay register 216 is to effectively advance the firing time of the nozzle.

As the print head is scanned back and forth across the sheet 4, firing time control signals from the delay counter 216, which have been appropriately advanced or delayed, are supplied to the various print heads. Of course, each process can be provided for each print head.

An advance or delay can, of course, be effected in any number of incremental values. In accordance with exemplary embodiments, advances and delays are effected in units of ⅓ of a pixel, with the offsets being stored and implemented via the control of the control system illustrated in FIG. 2.

Figure 3:
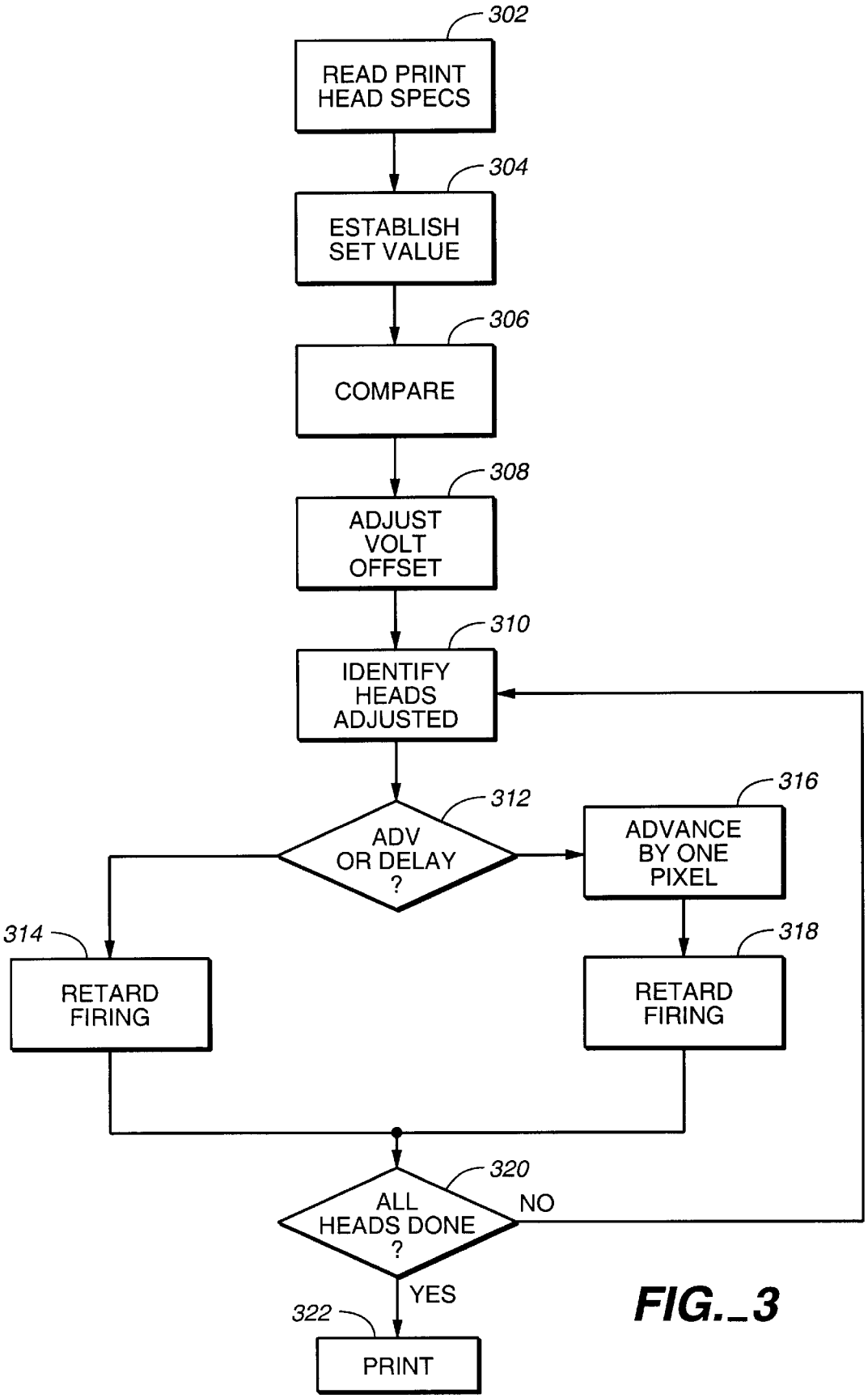
FIG. 3 illustrates an exemplary flow chart of operation implemented by the FIG. 2 control system in accordance with the present invention.

Having described an exemplary control system for use in accordance with an exemplary embodiments of the present invention, a review of the operation implemented by the FIG. 2 control system will now be provided with respect to FIG. 3 as illustrated therein, in a first step, manufacturer specified information for each print head is read and stored in a data base and/or appropriately encoded on the print head via, for example, a bar code label. In step 304, a set value for the range of characteristic drop volume for the print heads used in the print device is established. In step 306, the characteristic drop volume of each print head is compared with the set value to determine any variations. In step 308, a voltage offset for each print head is adjusted on the basis of the comparison in step 306. In step 310, once the drop volume of all print heads has been adjusted, the firing time of the ink jet nozzles in each adjusted print head is compensated by first correlating ink jet nozzle firing times to voltage offsets implemented via step 308 using a lookup table. The output from the look-up table used in step 310 is a firing time advance or delay for each print head. In decision block 312, this data is examined on a head-by-head basis to determine whether the firing time of each head is to be advanced or delayed.

If the firing time is to be delayed for a given head, an appropriate delay output from the look-up table used in conjunction with step 310 is added to the firing time associated with that head to retard its firing in step 314. In contrast, where an advance is to be implemented, the main controller signals the raster image process controller to advance the data by one full pixel in step 316. Further, the main controller signals the delay register to store an appropriate delay of an amount less than one pixel in the delay register 216 via step 318. The net effect of advancing the data by one full pixel and adding in a fractional delay via step 318 provides for a fractional advance in the firing time.

In step 320, a decision is made as to whether all heads have been appropriately compensated. If so, compensation has been completed and printing can be initiated as represented by step 322. If not, then flow returns to step 310 to compensate the next firing time of the next head.

Those skilled in the art will appreciate that the present invention is not limited to the exemplary embodiments described above. For example, although the delay in firing time of the ink jet nozzles associated with a given print head has been discussed with respect to the use of a delay counter 216 and a FIFO 226, any hardware or software mechanism for introducing such a delay can be used. It is only important that nozzles whose firing time should be delayed be identified, and that the firing time then be altered accordingly.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. Method for controlling a printing device having at least one ink jet nozzle, said method comprising the steps:

adjusting an offset control of a power supply used to control drop volume of said at least one ink jet nozzle; and compensating a firing time of said ink jet nozzle as a function of said offset control to account for a change in output ink velocity of said at least one nozzle.

2. Method according to claim 1, wherein said step of adjusting further includes a step of:

changing a voltage offset associated with a given print head.

3. Method according to claim 2, wherein said voltage offset is used to adjust the drop volume of a piezoelectric print head having a plurality of ink jet nozzles.

4. Method according to claim 1, wherein said step for compensating further includes the step of:

correlating said offset control to a predetermined change in ink velocity output from said ink jet nozzle.

5. Method according to claim 4, wherein said predetermined changes in ink jet velocity are stored in a look-up table which can be accessed by said offset control.

6. Apparatus for controlling a printing device comprising:

means for adjusting an offset control of a power supply used to control drop volume of said at least one ink jet nozzle; and means for compensating a firing time of said ink jet nozzle as a function of said offset control to account for a change in output ink velocity of said at least one nozzle.

7. Apparatus according to claim 6, wherein said adjusting means further includes:

at least one voltage regulator for adjusting voltage supplied to at least one print head of said printing device to thereby vary the drop volume of said at least one ink jet nozzle in said at least one print head.

8. Apparatus according to claim 7, wherein said at least one regulator adjusts the drop volume of a plurality of ink jet nozzles included in at least one print head.

9. Apparatus according to claim 7, wherein said adjusting means further includes:

a plurality of regulators, each of which provides drop volume control for the ink jet nozzles of one or plural print heads in said printing device.

10. Apparatus according to claim 6, wherein said compensating means includes at least one memory for correlating said offset control to a change in firing time of said at least one ink jet nozzle.

11. Apparatus according to claim 10, wherein said memory is a look-up table.

12. Apparatus according to claim 10, wherein said compensating means further includes:

means for introducing an appropriate delay or advance of said firing time as a function of said offset control.

13. Apparatus according to claim 12, wherein said memory is a look-up table.

14. Apparats according to claim 13, wherein a look-up table is provided for each of plural print heads in said printing device.

15. Apparatus according to claim 10, wherein said compensating means further includes:

at least one first-in first-out memory for controlling a supply of control data to said at least one ink jet nozzle; and at least one register for controlling an output of said data to said at least one ink jet nozzle from said first-in first-out memory based on an adjustment to said firing time as a function of said offset control.

16. Method according to claim 1, further including a step of:

performing a test scan to identify ink jet nozzles of said printing device whose firing time requires compensation.

17. A printing device control system comprising:

at least one first-in first-out memory for supplying control data to at least one ink jet nozzle of a printing head;

at least one register for enabling an output of said at least one first-in first-out memory, said delay of said at least one register being determined as a function of a power supply offset control used to control drop volume of said at least one ink jet nozzle.

18. A print device control system according to claim 17, further including:

at least one voltage regulator for adjusting an offset control of a power supply used to control drop volume of at least one ink jet nozzle.

* * * * *